US006194116B1

(12) United States Patent
Nishihara et al.

(10) Patent No.: US 6,194,116 B1
(45) Date of Patent: Feb. 27, 2001

(54) TONER CONTAINING SPECIFIC ALKYL CARBOXYLIC ACID WITH FINE PARTICLES EXTERNALLY ADDED

(75) Inventors: Yoshikazu Nishihara, Itami; Junichi Tamaoki, Sakai; Masayuki Hagi, Minoo; Takeshi Arai, Akashi, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/461,114

(22) Filed: Dec. 14, 1999

(30) Foreign Application Priority Data

Dec. 15, 1998 (JP) ..... 10-355794
Dec. 15, 1998 (JP) ..... 10-355798

(51) Int. Cl.[7] ..... G03G 9/097
(52) U.S. Cl. ..... 430/111
(58) Field of Search ..... 430/106, 109, 430/110, 111

(56) References Cited

U.S. PATENT DOCUMENTS

| | | | |
|---|---|---|---|
| 4,187,329 | 2/1980 | Crooks | 430/110 |
| 4,883,736 | 11/1989 | Hoffend et al. | 430/110 |
| 4,933,253 | 6/1990 | Aoki et al. | 430/110 |
| 4,943,505 | 7/1990 | Aoki et al. | 430/109 |
| 5,037,717 | 8/1991 | Ishii et al. | 430/110 |
| 5,482,805 | 1/1996 | Grande et al. | 430/106 |
| 5,486,443 | 1/1996 | Grande et al. | 430/106 |
| 5,660,963 * | 8/1997 | Doujo et al. | 430/109 |
| 5,759,731 | 6/1998 | Hagi et al. | 430/106.6 |
| 5,840,459 * | 11/1998 | Ohno et al. | 430/109 |
| 6,015,647 * | 1/2000 | Ugai et al. | 430/110 |

FOREIGN PATENT DOCUMENTS

| | | |
|---|---|---|
| 59-41317 | 3/1984 | (JP) . |
| 60-186876 | 9/1985 | (JP) . |
| 7-160165 | 6/1995 | (JP) . |
| 8-76406 | 3/1996 | (JP) . |
| 10-142840 | 5/1998 | (JP) . |

* cited by examiner

*Primary Examiner*—John Goodrow
(74) *Attorney, Agent, or Firm*—Burns, Doane, Swecker & Mathis, LLP

(57) ABSTRACT

The present invention relates to toner comprising:

toner particles containing a binder resin and a colorant; and organic fine particles admixed with the toner particles, the organic fine particles having a volume average particle size of 0.1 to 20 $\mu$m and containing alkyl carboxylic acid having a number average molecular weight of 300 to 1000. The organic fine particles may be specified by an average number of carbon atoms of 20 to 70.

20 Claims, No Drawings

TONER CONTAINING SPECIFIC ALKYL CARBOXYLIC ACID WITH FINE PARTICLES EXTERNALLY ADDED

This application is based on applications Hei 10-355794 and Hei 10-355798 filed in Japan, the contents of which are hereby incorporated by reference.

BACKGROUND OF THE INVENTION

1. Field of the Invention

The present invention relates to an electrostatic latent image-developing toner for forming a monochrome image or a full color image, and also concerns an image-forming method for forming images with such a toner.

2. Description of the Related Art

In the field of electrophotography, it is an effective method to miniaturize the toner particle size in order to obtain high image quality. However, the miniaturization of the toner particle size causes degradation in the cleaning properties and the electrification properties. Moreover, in order to improve the fluidity that deteriorates due to the miniaturization of the toner particle size, a little excessive fluidizing agent is added; however, an increased amount of the fluidizing agent also causes degradation in the cleaning properties and the electrification properties.

With respect to techniques proposed to improve the cleaning properties, for example, Japanese Patent Application (JPA) Laid-Open No. 76406/1996 disclosed that organic fine particles made of polyvinylidene fluoride are added to the toner surface, or JPA Laid-Open No. 160165/1995 discloses that zinc stearate is added to the toner surface.

U.S. Pat. No. 4,933,253, U.S. Pat. No. 4,943,505 and JPA Laid-Open No.186876/1985 have proposed techniques in which fine particles of methylmethacrylate or copolymer particles thereof with styrene are added to the toner surface as an cleaning-assist agent, or U.S. Pat. No. 4,187,329 has proposed a technique in which fine particles of a fluorine compound, typically Teflon, is added to the toner surface as a cleaning-assist agent.

Furthermore, for example, in a technique proposed by U.S. Pat. No. 4,883,736, alkyl alcohol with a long chain is added to the toner surface.

With respect to inorganic fine particles, for example, U.S. Pat. No. 5,759,731 has proposed a method in which a metal oxide such as strontium titanate is added to the toner surface as a polishing agent for a photosensitive member.

However, in the above-mentioned method for adding a metal salt of fatty acid such as zinc stearate to the toner surface, the cleaning properties improve, but an increased amount of addition to the toner raises a problem in which the electrification properties of toner deteriorates extremely.

With respect to metal oxides such as alkyl alcohol with a long chain and strontium titanate, the adverse effect is not as serious as the above-mentioned metal salt of fatty acid. The addition thereof to the toner surface, however, tends to cause degradation of the electrification properties of toner.

With respect to the fine particles of methylmethacrylate or a copolymer thereof with styrene or fine particles of a fluorine compound, the addition thereof to the toner surface gives a little improving effect to the cleaning properties. But, it gives little effect, in particular, to prevent black spots on the photosensitive member caused by toner components.

SUMMARY OF THE INVENTION

An object of the present invention is to provide a toner in which the cleaning properties and the electrification properties are not degraded even when a toner particles size is made small in an attempt to meet the demand for high image quality.

Another object of the present invention is to provide a toner which can achieve high image quality, high reliability as well as high durability.

Still another object of the present invention is to provide a toner which has an excellent electrification build-up properties.

The other object of the present invention is to provide a toner which maintains excellent charging stability even when used for a long time.

These objects are achieved by adding organic fine particles that has a volume average particle size in the range of 0.1 to 20 $\mu$m and contains a specific alkyl carboxylic acid to the toner.

DETAILED DESCRIPTION OF THE INVENTION

The present invention relates to a toner comprising:

toner particles containing a binder resin and a colorant; and organic fine particles admixed with the toner particles, the organic fine particles having a volume average particle size of 0.1 to 20 $\mu$m and containing alkyl carboxylic acid having a number average molecular weight of 300 to 1000.

The addition of the above-mentioned organic fine particles in accordance with the present invention makes it possible to provide a toner which is not susceptible to degradation in the cleaning properties and the electrification properties even when the toner particle size is miniaturized in an attempt to meet the demand for high image quality. High image quality can be achieved as well as high reliability and durability.

It is effective to use the toner of the present invention in a toner image-forming method in which an electrostatic latent image, which is developed but not transferred onto a sheet of recording paper, is formed between the formations of electrostatic latent images corresponding to the images when forming a plurality of desired images.

A carboxylic acid used in the present invention is mainly made of a saturated hydrocarbon carboxylic acid with a straight chain having a number average molecular weight (Mn) in the range of 300 to 1000, preferably 300 to 800, more preferably 350 to 750, and an acid value (mgKOH/g) in the range of 50 to 130, preferably 60 to 120. This compound may be represented by the average number of carbon atoms instead of the number average molecular weight. The average number of carbon atoms is in the range of C20 to C70, preferably C22 to C55, more preferably C24 to C50, still more preferably C24 to C48. Such an alkyl carboxylic acid is commercially available as Unicid™ carboxylic acid made by Toyo Petrolite Co., Ltd. Moreover, it is desirable to use alkyl carboxylic acid having a specific gravity (g/cc) of 0.70 to 0.80, preferably 0.75 to 0.79 in the present invention.

In the present invention, the alkyl carboxylic acid may be specified only by the average number of carbon atoms or only by the number average molecular weight instead of the average number of carbon atoms, preferably being specified by the average number of carbon atoms and the acid value or by the average molecular weight and the acid value. Of course, the alkyl carboxylic acid may be specified by all the physical properties including the average number of carbon atoms, the average molecular weight and the acid value. In the present invention, the object of the invention is sufficiently achieved by an alkyl carboxylic acid specified by the average number of carbon atoms and the acid value, or the average molecular weight and the acid value. Normally, an alkyl carboxylic acid specified by the average molecular weight and the acid value is used as it is easy to specify it.

When an alkyl carboxylic acid that does not satisfy the above-mentioned physical properties is used, the heat resistance of toner may deteriorate, the electrification build-up properties of toner may deteriorate, fog may occur, and the effect for preventing black spots may be reduced.

The present invention uses an average molecular weight obtained by a permeation pressure method and a specific gravity measured by an ASTMD 1705, and an acid value measured by a BWM3.10A.

The above-mentioned alkyl carboxylic acid is externally added to a toner in the form of fine particles having a volume average particle size in the range of 0.1 to 20 $\mu$m, preferably 1 to 10 $\mu$m, more preferably 4 to 8 $\mu$m. If the size is smaller than 0.1 $\mu$m, the adhesion strength of the alkyl carboxylic acid to the toner surface increases, with the result that the effect for preventing black spots (BS) is reduced, and the amount of adhesion of the alkyl carboxylic acid to the charge-giving member increases; thus, fog is more likely to occur as the number of printed sheets of paper increases due to inappropriate toner charging. If the particle size is greater than 20 $\mu$m, the surface of the photosensitive member is not coated with the alkyl carboxylic acid, with the result that the alkyl carboxylic acid tends to be transferred with a toner image; thus, the effect for preventing BS is reduced and image noise is likely to occur.

In the case of an image-forming process with a monocolor toner (for example, a monochrome copying machine or printer) or in the case of an image-forming process with full-color toners, when organic fine particles are added to the respective color toners, an amount of addition of the organic fine particles to the toner particles is set in the range of 0.01 to 5 parts by weight, preferably 0.05 to 3 parts by weight, and more preferably 0.1 to 1 part by weight with respect to 100 parts by weight of the toner particles. The amount less than 0.01 part by weight makes it difficult to coat the surface of the photosensitive member with the organic fine particles, causing degradation in the effect for preventing BS. The amount exceeding 5 parts by weight tends to cause fog of the toner.

In the image-forming process with full-color toners, the organic fine particles may be added to any one of the toners of respective colors. In this case, an amount of addition of the organic fine particles is in the range of 0.04 to 5 parts by weight, preferably 0.2 to 3 parts by weight, and more preferably 0.4 to 1 part by weight with respect to 100 parts by weight of the toner particles. The amount less than 0.04 parts by weight makes it difficult to coat the surface of the photosensitive member with the organic fine particles, causing degradation in the effect for preventing BS. The amount exceeding 5 parts by weight causes the electrification properties of the charge-giving member to deteriorate as the number of copies increases, resulting in fog of the toner.

It is preferable to add inorganic fine particles to the toner together with the above-mentioned organic fine particles. With respect to the inorganic fine particles, silica, titanium oxide, strontium titanate, etc. are listed. Silica and titanium oxide is effective for improving toner fluidity. Strontium titanate is effective for polishing the surface of photosensitive member. Therefore, silica and/or titanium oxide are normally added to the toner. Strontium titanate is added thereto, if necessary. With respect to materials used in place of silica or titanium oxide, examples thereof include: alumina fine particles, magnesium fluoride fine particles, silicon carbide fine particles, boron carbide fine particles, titanium carbide fine particles, zirconium carbide fine particles, boron nitride fine particles, titanium nitride fine particles, zirconium nitride fine particles, magnetite fine particles, molybdenum disulfide fine particles, aluminum stearate fine particles, magnesium stearate fine particles, and zinc stearate fine particles. Normally, these fine particles are preliminarily subjected to hydrophobicization with a silane coupling agent, a titanium coupling agent, a higher fatty acid, silicone oil, etc.

The total addition of the inorganic fine particles is preferably set approximately in the range of 0.1 to 10 parts by weight, preferably 0.2 to 7 parts by weight, with respect to 100 parts by weight of the toner.

With respect to a negatively chargeable toner to which the above-mentioned organic fine particles are added, any known negatively chargeable toner can be used; and those fine particles are applied to a toner containing a binder resin made of, for example, styrene resins, acrylic resins, such as alkyl acrylate and alkyl methacrylate, styrene-acrylic copolymer resins, polyester resins, epoxy resins, silicon resins, olefin resins, amide resins, and a mixture thereof, and in particular. It is preferable that the organic fine particles are used in combination with a toner containing a polyester resin or an epoxy resin. In particular, with respect to full-color toners including cyan toner, magenta toner, yellow toner and black toner, a negatively chargeable toner including a binder resin made of a polyester resin or an epoxy resin, which has a number average molecular weight (Mn) in the range of 3000 to 6000, preferably 3500 to 5500, a ratio Mw/Mn between a weight average molecular weight (Mw) and a number average molecular weight (Mn) in the range of 2 to 6, preferably 2.5 to 5.5, a glass transition point in the range of 50 to 70° C., preferably 55 to 65° C., and a softening point in the range of 90 to 110° C., preferably 90 to 105° C., is preferably used. Such a toner is preferably combined with the above-mentioned organic fine particles.

Such a polyester resin can be prepared from a compound containing an etherified diphenol as an alcohol component and an aromatic dicarboxylic acid as an acid component.

With respect to the etherified diphenol, examples thereof include: polyoxypropylene (2,2)-2,2-bis (4-hydroxyphenyl) propane and polyoxyethylene (2)-2,2-bis(4-hydroxyphenyl) propane.

The following compounds may be used together with the etherified diphenol: diols such as ethylene glycol, diethylene glycol, triethylene glycol, 1,2-propylene glycol, 1,3-propylene glycol, 1,4-butanediol, and neopentylglycol, and sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

With respect to the aromatic dicarboxylic acid component, an aromatic dicarboxylic acid such as terephthalic acid and isophthalic acid, and anhydrides or lower alkyl esters of these acids can be used.

Fatty dicarboxylic acids such as fumaric acid, maleic acid, succinic acid, C4 to 18 alkyl or alkenyl succinic acids, or anhydrides or lower alkyl esters thereof may be adopted. Polyhydric carboxylic acids, such as 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, and anhydrides and lower alkyl esters thereof, maybe used in such a small amount as not to give adverse effects on the light-transmitting properties, etc. in order to adjust the acid value of the polyester resin and to improve the resin strength. When the above acid is contained in black toner, it is not particularly necessary to take the light-transmitting properties, etc. into consideration.

With respect to a positively chargeable toner to which the above-mentioned organic fine particles are added, any known positively chargeable toner can be used. Those fine particles may be applied to a toner containing a binder resin, such as a styrenic copolymer resin, a polyester resin and an epoxy resin. It is preferable to use the fine particles in the combination with a toner formed of a styrenic copolymer resin.

With respect to examples of styrenic monomers that constitute such styrenic copolymer resins, styrenic monomers, such as styrene, α-methylstyrene, p-methylstyrene, p-tert-butylstyrene and p-chlorostyrene, and derivatives thereof may be used.

With respect to monomers which is copolymerized with the styrenic monomer, the following components may be used: alkyl methacrylates, such as methyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-(methyl)butyl methacrylate, hexyl methacrylate, octyl methacrylate, nonyl methacrylate, decyl methacrylate, undecyl methacrylate and dodecyl methacrylate; alkyl acrylates, such as methyl acrylate, n-propyl acrylate, isopropyl acrylate, n-butyl acrylate, isobutyl acrylate, t-butyl acrylate, n-pentyl acrylate, isopentyl acrylate, neopentyl acrylate, 3-(methyl)butyl acrylate, hexyl acrylate, octyl acrylate, nonyl acrylate, decyl acrylate, undecyl acrylate, and dodecyl acrylate; unsaturated carboxylic acids, such as acrylic acid, methacrylic acid, itaconic acid and maleic acid; and vinyl monomers such as, acrylonitrile, maleic acid ester, itaconic acid ester, vinyl chloride, vinylacetate, vinyl benzoic acid, viny lmethyl ethyl ketone, vinyl hexyl ketone, vinyl methyl ether, vinyl ethyl ether, and vinyl isobutyl ether. Among these, alkyl methacrylates (with an alkyl group having carbon atoms of 1 to 17) and alkyl acrylates (with analkyl group having carbon atoms of 1 to 17) are preferably used.

In particular, it is preferable that a toner, which includes as a binder resin a styrene copolymer resin having an acid value in the range of 0 to 30 KOHmg/g, preferably 3 to 10 KOHmg/g, a number average molecular weight of 2000 to 10000, preferably 2500 to 7000, and a ratio of weight average molecular weight/number average molecular weight of 20 to 90, preferably 25 to 80, is used in the combination with the above-mentioned organic fine particles.

The toner used in the present invention includes a colorant within a normal range. Desired additive agents such as a charge-control agent, magnetic particles and wax may be added. An amount of those additives is set in a conventional manner.

The colorant used in the color toner is preferably subjected to a master batch treating or a flushing treating so as to improve the dispersing properties thereof. A content of the colorant is in the range of 2 to 15 parts by weight with respect to 100 parts by weight of the binder resin.

The composition of the present invention has a sufficient charge ability without addition of a charge-control agent. However, a known charge-control agent may be added, if necessary, without no limitation to specific ones. With respect to the charge-control agent for use in the color toner, colorless, white or light-color negative charge-control agents, which do not have adverse effects on the color tones and light-transmitting properties of the color toner, are used; and examples of such charge-control agents include a metal complex of salicylic acid, such as a zinc complex of salicylic acid derivatives, a calix arene compound and an organic boron compound. With respect to the salicylic acid metal complex, those disclosed in JPA Laid-Open No. 127726/1978 and JPA Laid-Open No. 145255/1987 maybe used; with respect to the calix arene compound, those disclosed in JPA Laid-Open No. 201378/1990 may be used; and with respect to the organic boron compound, those disclosed in JPA Laid-Open No. 221967/1990 may be used.

With respect to positive charge-control agents, for example, nigrosine dyes, triphenylmethane compounds, and quaternary ammonium salt compounds are listed. With respect to the triphenylmethane compounds, for example, those compounds disclosed in JPA Laid-Open No. 11455/1976, JPA Laid-Open No. 100457/1984 and JPALaid-Open No. 124955/1986 may be used. With respect to quaternary ammonium salt compounds, for example, those disclosed in JPA Laid-Open No. 70849/1992 may be used.

When such a charge-control agent is added, an amount thereof is set in the range of 0.1 to 10 parts by weight, preferably 0.5 to 5.0 parts by weight, with respect to 100 parts by weight of the binder resin.

The toner particles of the present invention may be manufactured by any method conventionally known, and adjusted so as to have a volume average particle size of 5 to 10 μm, preferably 6 to 9 μm, from the viewpoint of the high-precision reproducibility of images.

The toner of the present invention can be used as a two-component developing toner used together with a carrier, or as a mono-component developing toner without a carrier.

With respect to carriers used in combination with the toner of the present invention, conventionally known carriers used for two-component developer may be used; for example, carriers made of magnetic particles such as iron and ferrite, resin-coated carriers made by coating such magnetic particles with resin, or binder-type carriers made by dispersing magnetic fine particles in a binding resin may be used. From the viewpoint of high-quality images and prevention of carrier fog, the carrier is preferably adjusted so as to have a volume average particle size of 20 to 100 μm, preferably 30 to 80 μm.

EXAMPLES

The present invention is described in detail by referring to Examples; however, the present invention is not intended to be limited thereto.

(Preparation for polyester resins)

To a 2-liter four-necked flask were attached a reflux condenser, awater-separating device, anitrogen gas inlet tube, a thermometer and a stirrer. The flask was placed on a mantle heater. To the flask were loaded polyoxypropylene (2,2)-2,2-bis(4-hydroxyphenyl)propane (PO), polyoxyethylene(2,0)-2,2-bis(4-hydroxyphenyl)propane (EO), fumaric acid (FA) and telephthalic acid (TPA) so that amole ratio thereof was 5:5:5:4. While nitrogen gas was introduced into the flask, the loaded materials were heated, stirred for reaction. The progress of the reaction was traced by measuring an acid value. When a predetermined acid value was reached, the reaction was stopped. The polyester resin thus obtained had a number-average molecular weight (Mn) of 4800, a ratio of weight-average molecular weight (Mw) /number-average molecular weight (Mn) of 4.0, a glass transition point of 58° C. and a softening point of 100° C.

The number-average molecular weight and the weight-average molecular weight were measured by means of a gel permeation chromatography (807-IT: made by Nippon Bunko Kogyo K.K.) under the conditions as follows; 1 kg/cm$^3$ of tetrahydrofuran was flowed as a carrier solvent while the column was maintained at 40° C., and 30 mg of a sample to be measured was dissolved in 20 ml of tetrahydrofuran, and then, 0.5 mg of this solution was introduced together with the carrier solvent; thus these molecular weights were measured based upon polystyrene conversion.

The glass transition point was measured by a differential scanning calorimeter (DSC-200: made by Seiko Denshi K.K.) as follows; based upon alumina as the reference, 10 mg of a sample was measured under the conditions of a temperature-rise rate of 10° C./min, and the shoulder value of the main heat-absorption peak was defined as the glass transition point.

The softening point was measured by Flow Tester (CFT-500: made by Shimadzu Seisakusho K.K). A sample of 1.0 mg was used. A die having a pore diameter of 1 mm and a pore length of 1 mm was used. The measurements were carried out under conditions of a temperature-rise rate of 3.0° C./min, a preheating time of 180 seconds, an applied pressure of 30 kg and a measuring temperature range of 60 to 140° C. A temperature at the time of ½ flow-out of the sample was taken as a softening point.

(Preparation of toner particles M)

The above-mentioned polyester resin and magenta pigment (C.I. Pigment Red 184) were fed into a pressure kneader so as to be set at a weight ratio of 7:3 and kneaded. After cooled, the resulting kneaded materials were pulverized by a feather mill, to give a pigment master batch.

Ninty three parts by weight of the above-mentioned polyester resin were mixed with 10 parts by weight of the above-mentioned master batch in Henschel Mixer. The mixture was then kneaded by a twin screw extruding kneader. After cooed, the resulting kneaded materials were roughly pulverized by a feather mill, and finely pulverized by Jet Mill, and then classified to give toner particles M having a volume average particle size of 8.5 μm. The blow-off quantity of electrical charge of the toner particles M to iron powder was −53 μC/g. The blow-off quantity of electrical charge was measured by use of a carrier obtained in a carrier production example which will be described later instead of the iron powder. The obtained value was −20 μC/g.

In the measurement of the blow-off quantity of electrical charge based upon the blow-off method, 25 g of the reference iron powder carrier (Z150/250 made by Powdertech K.K.) and 50 mg of the sample were loaded into a polyethylene bin of 25 cc, and mixed by a turbuler mixer for one minute, and 0.1 g of the sample was then loaded into a measuring container having a stainless screen of 400 mesh, and the measurement was carried out by means of a blow-off charging quantity measuring device (TB-200: made by Toshiba Chemical K.K.) under the conditions of a nitrogen gas flow rate of 1.0 kgf/cm$^2$, and a flowing period of 60 seconds.

(Preparation of toner particles B)

One hundred parts by weight of the above-mentioned polyester resin, 3 parts by weight of carbon black (Mogul L: made by Cabot K.K.) and 2 parts by weight of a charge-control agent (zinc complex of salicylic acid: E-84: made by Orient Kagaku Kogyo K.K.) were mixed in Henschel Mixer The mixture was then kneaded by means of a twin screw extruding kneader. After cooled, the resulting kneaded materials were roughly pulverized by a feather mill, and finely pulverized by Jet Mill, and then classified to give toner particles B having a volume average particle size of 8.5 μm. The blow-off quantity of electrical charge of the toner particles B to iron powder was −48 μC/g. The blow-off quantity of electrical charge was measured after having replaced the iron powder with a carrier obtained in a carrier production example which will be described later. The resulting value was −18 μC/g.

(Preparation of toner particles C)

Toner particles C were obtained in the same manner as the preparation of toner particles M except that the magenta pigment was replaced with a cyan pigment, copper phthalocyanine pigment.

(Preparation of toner particles Y)

Toner particles Y were obtained in the same manner as the preparation of toner particles M except that the magenta pigment was replaced with C.I. Pigment Yellow.

(Production example of carriers)

To a 500 ml flask provided with a stirrer, a condenser, a thermometer, a nitrogen gas inlet tube and a dropping device was loaded 100 parts by weight of methylethylketone. Separately, 36.7 parts by weight of methylmethacrylate, 5.1 parts by weight of 2-hydroxyethylmethacrylate, 58.2 parts by weight of 3- methacryloxypropyltris(trimethylsiloxy) silane and 1 part by weight of 1,1'-azobis(cyclohexane-1-carbonitrile) were dissolved in 100 parts by weight of methylethylketone at 80° C. under a nitrogen atmosphere. A solution thus obtained was dropped into the reactor vessel in two hours. The mixture was matured for 5 hours.

To the resin thus obtained was added as a crosslinking agent an isophoronediisocyanate/trimethylolpropane adduct (IPDI/TMP system: NCO%=6.1%) so as to adjust the OH/NCO mole ratio to 1/1. The resultant was diluted with methylethylketone to give a coat resin solution having a solid ratio of 3% by weight.

Calcined ferrite particles F-300 (volume-average particle size: 50 μm, made by Powdertech K.K.) as a core material were coated with the coat resin solution by Spira Cota (made by Okada Seiko K.K.) and dried so that an amount of coated resin to the core material is set at 1.5% by weight. The resultant carrier was left in a hot-air circulating oven for one hour at 160° C. so as to be calcined. After cooled off, the ferrite particle bulk was pulverized by means of a sieve shaker having screen meshes of 106 μm and 75 μm to give a carrier coated with resin.

Preparation of toners

Examples 1 to 11, Comparative Examples 1 to 5

The toner particles M or B obtained by the above-mentioned process were mixed with organic fine particles and hydrophobic silica R974 (made by Nippon Aerosil K.K.), titanium oxide STT-30A (made by Titan Kogyo K.K.) or strontium titanate SW-100 (made by Titan Kogyo K.K.) in Henschel Mixer at an amount shown in Table 1. Thereafter, the mixture was sieved by means of a round sieve shaker having meshes of 200μm, to give toners of Examples and Comparative Examples shown in Table 1.

The organic fine particles used in Examples 1 to 7 and 9 to 11 as well as in Comparative Examples 2 and 3 were alkyl carboxylic acid (Unicid™700 (made by Toyo Petrolite Co., Ltd.)), and the organic fine particles used in Example 8 was alkyl carboxylic acid (Unicid™350 (made by Toyo Petrolite Co., Ltd.)). The organic fine particles used in Comparative Example 4 was made from polyethylene wax (Ceridust 3620 (made by Clariant International Ltd.).

The above-mentioned mixing process was carried out as follows. The hydrophobic silica and/or the titanium oxidewere mixed with the toner particles in Henschel Mixer, and then to the resultant mixture were admixed the organic fine particles and/or the strontium titanate.

Preparation of toners

Examples 12 to 17, Comparative Example 6

In Examples 12 to 17 and Comparative Example 6, organic fine particles having a volume average particle size of 6 μm, made of alkyl carboxylic acid (Unicid™700 (made by Toyo Petrolite Co., Ltd.)) (having an average number of carbon atoms of 45, a molecular weight (Mn) of 700, a specific gravity of 0.78 and an acid value of 63) were mixed with respective toner particles shown in Table 2 at an amount shown in Table 2, together with one part by weight of hydrophobic silica in Henschel Mixer. Thereafter, the resultant mixture was sieved by means of a round sieve shaker having meshes of 200 μm, to give toners of Examples and Comparative Examples shown in Table 2.

The above-mentioned mixing process was carried out as follows. The hydrophobic silica was mixed with the toner particles in Henschel Mixer, and then the organic fine particles were admixed with the mixture.

Evaluation (1) Fusing and fixation of toner components on a photosensitive member (BS)

Examples 1 to 10 as well as Comparative Examples 1 to 4

The toners of Examples 1 to 10 and Comparative Examples 1 to 4 were mixed with the carrier obtained in the above so as to be set at 5% by weight to the carrier. Thus, two-component developers were prepared.

With respect to the resultant developers, by means of a Di620 (made by Minolta K.K.) which was modified so that an electrostatic latent image, which is formed between electrostatic latent images that correspond to an image and which is developed but is not transferred onto recording paper, can be formed with a width of approximately 3 mm in the length direction of the photosensitive member at a ratio of once every 10 sheets, one-sheet intermittent endurance copying processes (in which the system was completely stopped for each copied sheet, and this process was repeated) were carried out on an image with a B/W of 6% and 5000 copies were made.

The evaluation was made to be ranked as follows: cases in which no fusing and fixation of the externally additive agents was found on the photosensitive member even when observed by an electron microscope or in which, although fusing and fixation of the externally additive agents was found on the photosensitive member under an electron microscope, no fusing and fixation of the externally additive agents was found under visual observation without any image noise, were evaluated as ○; cases in which although fusing and fixation of the externally additive agents or toner components was found on the photosensitive member under visual observation, no image noise was observed were evaluated as Δ; and cases in which fusing and fixation of the externally additive agents and the toner components, and the noise on copied images caused therefrom were found on the photosensitive member under visual observation were evaluated as X. The results are shown in Table 3:

Example 11 and Comparative Example 5

The toners of Example 11 and Comparative Example 5 were used as mono-component developers. By use of an LP9200 (made by Epson K.K.), one-sheet intermittent endurance copying processes were carried out on an image with a B/W of 6% and 5000 copies were made. Evaluation was carried out in the same manner as described above. The results are shown in Table 3.

Examples 12 to 17 and Comparative Example 6

The toners of Examples 12 to 17 and Comparative Example 6 were mixed with the carrier obtained in the above so as to be set at 5% by weight relative to the carier. Thus, two-component developers were prepared.

The resultant developers were loaded into a full-color copying machine CF900 (made by Minolta K.K.) which was modified so that an electrostatic latent image, which is formed between electrostatic latent images that correspond to an image and which is developed but is not transferred onto recording paper, can be formed with a width of approximately 3 mm in the length direction of the photosensitive member at a ratio of once every 3 sheets. A full-color image was formed. Five thousand (5000) copies were made. Evaluation was carried out in the same manner as described above. The results are shown in Table 4.

(2) Fog after long running

Examples 1 to 10 and Comparative Examples 1 to 4

The toners of Examples 1 to 10 and Comparative Examples 1 to 4 were mixed with the carrier obtained in the above so as to be set at 5% by weight to the carrier. Thus, two-component developers were prepared.

The resultant developers were loaded into a Di620 (made by Minolta K.K.). Copy was made continuously on an image with a B/W of 15% and 10000 copies were made.

Evaluation was made on the images to be ranked as follows: cases in which no fog was found on the white portion of the image were evaluated as ○; cases in which although fog was found slightly, no problem arose in practical use were evaluated as Δ; and cases in which fog was observed, resulting in practical use were evaluated as X. The results are shown in Table 3:

Example 11 and Comparative Example 5

The toners of Example 11 and Comparative Example 5 were used as mono-component developers. By use of an LP9200 (made by Epson K.K.), copy was made continuously on an image with a B/W of 15% and 5000 copies were made. Evaluation was carried out in the same manner as described above. The results are shown in Table 3.

Examples 12 to 17 and Comparative Example 6

The toners of Examples 12 to 17 and Comparative Example 6 were mixed with the carrier obtained in the above so as to be set at 5% by weight to the carrier; thus, two-component developers were prepared.

The resultant developers were loaded into a full-color copying machine CF900 (made by Minolta K.K.), and a full-color image was formed. Five thousand (5000) copies were made. Evaluation was carried out in the same manner as described above. The results are shown in Table 4.

(3) Heat resistance

Each of the toners (approximately 5 g) after preparation was loaded into a glass screw tube of 50 cc, and then left in a constant temperature bath at 55° C. for 24 hours. Then, each toner was taken out of the screw tube. The toner was visually evaluated on its aggregated state, and cases in which no aggregation was found were evaluated as ○; cases in which although any aggregation was found, it was easily pulverized with a slight pressure were evaluated as Δ; and cases in which the aggregation was hard to be pulverized even with a pressure were evaluated as X. The results are shown in Tables 3 and 4:

TABLE 1

| | Toner M or B | Organic fine particles: volume average particle size D50(μm) | average number of carbon atoms(−) | addition amount (parts by weight) | molecular weight (Mn) | specific gravity (g/cc) | acid value (KOHMg/g) | Addition amount of inorganic fine particles to toner: hydrophobic silica (parts by weight) | titanium oxide (parts by weight) | strontium titanate (parts by weight) |
|---|---|---|---|---|---|---|---|---|---|---|
| Ex. 1 | M | 6 | 47 | 1 | 700 | 0.78 | 63 | 1 | | |
| Ex. 2 | M | 6 | 47 | 1 | 700 | 0.78 | 63 | | 3 | |
| Ex. 3 | M | 6 | 47 | 1 | 700 | 0.78 | 63 | 1 | | 2 |
| Ex. 4 | M | 0.3 | 47 | 0.05 | 700 | 0.78 | 63 | 1 | 1 | 2 |
| Ex. 5 | M | 0.3 | 47 | 0.05 | 700 | 0.78 | 63 | 1 | | |
| Ex. 6 | M | 15 | 47 | 0.05 | 700 | 0.78 | 63 | 1 | | |
| Ex. 7 | M | 15 | 47 | 4 | 700 | 0.78 | 63 | 1 | | |
| Ex. 8 | M | 0.3 | 25 | 4 | 375 | 0.78 | 115 | 0.3 | | |
| Ex. 9 | M | 6 | 47 | 1 | 700 | 0.78 | 63 | 3 | 1 | 4 |
| Ex. 10 | M | 0.3 | 47 | 0.05 | 700 | 0.78 | 63 | 1 | | |
| Ex. 11 | B | 6 | 47 | 1 | 700 | 0.78 | 63 | | | |
| Comp. Ex. 1 | M | — | — | 0 | — | — | — | 1 | | |
| Comp. Ex. 2 | M | 0.05 | 47 | 0.1 | 700 | 0.78 | 63 | 1 | | |
| Comp. Ex. 3 | M | 30 | 47 | 0.1 | 700 | 0.78 | 63 | 1 | | |
| Comp. Ex. 4 | B | 6 | 400 | 1 | 6000 | 0.97 | 0 | 3 | | |
| Comp. Ex. 5 | B | — | — | 0 | — | — | — | 1 | | |

TABLE 2

| | Addition amount of organic fine particles (parts by weight): toner M magenta | toner C cyan | toner Y yellow | toner B black |
|---|---|---|---|---|
| Example 12 | 0.2 | 0 | 0 | 0 |
| Example 13 | 0 | 0.2 | 0 | 0 |
| Example 14 | 0 | 0 | 0.2 | 0 |
| Example 15 | 0 | 0 | 0 | 0.2 |
| Example 16 | 0.05 | 0.05 | 0.05 | 0.05 |
| Example 17 | 0.05 | 0.05 | 0.05 | 0.05 |
| Comparative Example 6 | 0 | 0 | 0 | 0 |

TABLE 3

| | Electrostatic latent image between images | Developer | Fusing and fixation of toner component | Fog after long running | Heat resistance |
|---|---|---|---|---|---|
| Ex. 1 | none | two component | ○ | ○ | ○ |
| Ex. 2 | none | two component | ○ | Δ | ○ |
| Ex. 3 | none | two component | ○ | ○ | ○ |
| Ex. 4 | none | two component | ○ | ○ | ○ |
| Ex. 5 | none | two component | Δ | ○ | ○ |
| Ex. 6 | none | two component | Δ | ○ | ○ |
| Ex. 7 | none | two component | ○ | Δ | ○ |
| Ex. 8 | none | two component | ○ | ○ | Δ |
| Ex. 9 | none | two component | ○ | Δ | ○ |

TABLE 3-continued

| | Electrostatic latent image between images | Developer | Fusing and fixation of toner component | Fog after long running | Heat resistance |
|---|---|---|---|---|---|
| Ex. 10 | yes | two component | ○ | ○ | ○ |
| Ex. 11 | none | mono component | ○ | ○ | ○ |
| Comp. Ex. 1 | none | two component | X | X | ○ |
| Comp. Ex. 2 | none | two component | X | X | ○ |
| Comp. Ex. 3 | none | two component | X | Δ | ○ |
| Comp. Ex. 4 | none | two component | X | X | ○ |
| Comp. Ex. 5 | none | mono component | X | X | ○ |

TABLE 4

| | Formation of electrostatic latent image between images by toner: toner M magenta | toner C cyan | toner Y yellow | toner B black | Fusing and fixation of toner component | Fog after long running | Heat resistance |
|---|---|---|---|---|---|---|---|
| Ex. 12 | none | none | none | none | Δ | Δ | ○ |
| Ex. 13 | none | none | none | none | Δ | Δ | ○ |
| Ex. 14 | none | none | none | none | Δ | Δ | ○ |
| Ex. 15 | none | none | none | none | Δ | ○ | ○ |
| Ex. 16 | none | none | none | none | Δ | ○ | |
| Ex. 17 | yes | yes | yes | yes | ○ | ○ | ○ |
| Comp. Ex. 6 | none | none | none | none | x | x | ○ |

(Preparation of toner particles B2)

Thermoplastic styrene-acrylic resin 100 parts by weight (Copolymer of styrene-butyl acrylate-butyl methacrylate-methacylic acid (monomer weight ratio =7 : 1.4 :0.2; acid value 6.5 KOH mg/g))

Anti-offset Additive Agent

Polypropylene wax (softening point: approximately 145° C., acid value 0)

(Viscol 660F, made by Sanyo Kasei K.K.) 2 parts by weight

Carbon black (Mogul L: made by Cabot K.K.) 10 parts by weight

Nigrosine dye 5.0 parts by weight (Nigrosine base EX, made by Orient Kagaku K.K.)

Magnetic particles (MFP-2, made by TDK K.K.) 2 parts by weight

The above materials were mixed in Henschel Mixer (capacity 75 liter) at 3000 rpm for three minutes. The mixture was continuously kneaded and extruded by use of a screw extruding kneader (TEMSO: made by Toshiba Kikai K.K.) at a temperature of 120° C. under the conditions of an amount of supply of 30 kg/hr and the number of screw revolutions of 150 rpm, and then pressed and extended by press rollers having a nip width of 1 mm, and was further cooled forcedly on a belt cooler.

This kneaded materials were coarsely pulverized by a feather mill (2 mm mesh). The pulverized materials were then finely pulverized to 11 μm by use of a mechanical pulverizer (Cryptron KTM-Type O: made by Kawasaki Jyukogyo K.K.). The coarsely pulverized particles were removed by Jet mill (IDS-Type Z: made by Nippon Pneumatic MFG) provided with a natural flow type classifier. The super finely pulverized particles were removed by a rotor-type classifier (50 ATP classifier; made by Hosokawa Micron K.K.). Thus, positively chargeable toner particles B2 having a volume average particle size of 8 μm were obtained.

Preparation of toners

Examples 18 to 27, Comparative Examples 7 to 10

The toner particles B2 obtained in the above were mixed with organic fine particles having the properties shown in Table 5 and hydrophobic silica RA200HS (made by Nippon Aerosil K.K.), titanium oxide STT-30A (made by Titan Kogyo K.K.) in Henschel Mixer at an amount shown in Table 5. The resultant mixture was sieved by use of a round sieve shaker having meshes of 200 μm to give toners of Examples and Comparative Examples shown in Table 5.

The organic fine particles used in Examples 18 to 24 and 26 and 27 as well as in Comparative Examples 8 and 9 were made of alkyl carboxylic acid (Unicid™700 (made by Toyo Petrolite Co., Ltd.)). The organic fine particles used in Example 25 was made of alkyl carboxylic acid (Unicid™350 (made by Toyo Petrolite Co., Ltd.)). The organic fine particles used in Comparative Example 10 was made of polyethylene wax (Ceridust 3620 (made by Clariant International Ltd.)).

The above-mentioned mixing process was carried out as follows. Thehydrophobic silica and/or the titanium oxidewere mixed with the toner particles in Henschel Mixer, and then to the rsultant mixture were admixed the organic fine particles and/or the strontium titanate.

The following binder type carriers were manufactured so as to be used for evaluating the toners as will be described later.

Preparation of carriers (binder type carriers)

| Components | Parts by weight |
|---|---|
| Polyester resin (made by Kao K.K.: NE-1110) | 100 |
| Inorganic magnetic particles (made by TDK K.K: MFP-2) | 500 |
| Carbon black (made by Mitsubishi Kasai K.K: MA#8) | 2 |

The above materials were sufficiently mixed in Henschel Mixer, and melt-kneaded by an extruding kneader which was set at 180° C. in the cylinder section and at 170° C. in the cylinder head section. After cooled, the kneaded materials were coarsely pulverized, and finely pulverized by JetMill, and then classified by an air classifier. Thus, a magnetic carrier having a volume average particle size of 55 μm was obtained.

Fusing and fixation of toner components on a photosensitive member (BS)

A copying machine (EP4050; made by Minolta K.K.) which was modified so that an electrostatic latent image, which is formed between electrostatic latent images that correspond to an image and which is developed but is not transferred onto recording paper, can be formed with a width of approximately 3 mm in the length direction of the photosensitive member at a ratio of once every 5 sheets, was used. The toner and the carrier obtained as described above were loaded to this copying machine, and one-sheet intermittent endurance copying processes were carried out on an image with a B/W ratio of 6% and 5000 copies were made.

The evaluation was made to be ranked as follows: cases in which no fusing and fixation of the externally additive agents was found on the photosensitive member even when observed by an electron microscope or in which, although fusing and fixation of the externally additive agents was found on the photosensitive member under an electron microscope, no fusing and fixation of the externally additive agents was found under visual observation without any image noise, were evaluated as ○; cases in which although fusing and fixation of the externally additive agents or toner components was found on the photosensitive member under visual observation, no image noise was observed were evaluated as Δ; and cases in which fusing and fixation of the externally additive agents or the toner components, and the noise on copied images caused therefrom were found on the photosensitive member under visual observation were evaluated as X. The results are shown in Table 6:

Fog After Long Running

By use of a copying machine (EP4050 made by Minolta K.K.), copy was made continuously on an image with a B/W of 15% and 100000 copies were made.

Evaluation was made on the images to be ranked as follows: cases in which no fog was found on the white portion of the image were evaluated as ○; cases in which although fog was found slightly, no problems arose in practical use were evaluated as Δ; and cases in which fog was observed, resulting in practical use were evaluated as X. The results are shown in Table 6:

Heat Resistance

Each of the toners (approximately 5 g) after preparation was loaded into a glass screw tube of 500 cc, and then left in a constant temperature bath at 50° C. for 24 hours. Then, each toner was taken out of the screw tube. Toner was visually evaluated on its aggregated state, and cases in which no aggregation was found were evaluated as ○; cases in which although any aggregation was found, it was easily pulverized with a slight pressure were evaluated as Δ; and cases in which the aggregation was hard to be pulverized even with a pressure were evaluated as X.

TABLE 1

| | Organic fine particles | | | | | | Addition amount of inorganic fine particles to toner | | |
|---|---|---|---|---|---|---|---|---|---|
| | volume average particle size D50(μm) | average number of carbon atoms(–) | addition amount (parts by weight) | molecular weight (Mn) | specific gravity (g/cc) | acid value (KOHMg/g) | hydrophobic silica (parts by weight) | titanium oxide (parts by weight) | strontium titanate (parts by weight) |
| Ex. 18 | 6 | 47 | 1 | 700 | 0.78 | 63 | 0.5 | | |
| Ex. 19 | 6 | 47 | 1 | 700 | 0.78 | 63 | | 1.5 | |
| Ex. 20 | 6 | 47 | 1 | 700 | 0.78 | 63 | 0.5 | | 3 |
| Ex. 21 | 6 | 47 | 1 | 700 | 0.78 | 63 | 0.5 | 0.5 | 3 |
| Ex. 22 | 0.3 | 47 | 0.05 | 700 | 0.78 | 63 | 0.5 | | |
| Ex. 23 | 15 | 47 | 0.05 | 700 | 0.78 | 63 | 0.5 | | |
| Ex. 24 | 15 | 47 | 4 | 700 | 0.78 | 63 | 0.5 | | |
| Ex. 25 | 0.3 | 25 | 4 | 375 | 0.78 | 115 | 0.3 | | |
| Ex. 26 | 6 | 47 | 1 | 700 | 0.78 | 63 | 1.5 | 0.5 | 2 |
| Ex. 27 | 0.3 | 47 | 0.05 | 700 | 0.78 | 63 | 1 | | |
| Comp. Ex. 7 | — | — | 0 | — | — | — | 0.5 | | |
| Comp. Ex. 8 | 0.05 | 47 | 0.1 | 700 | 0.78 | 63 | 0.5 | | |
| Comp. Ex. 9 | 30 | 47 | 0.1 | 700 | 0.78 | 63 | 0.5 | | |
| Comp. Ex. 10 | 6 | 400 | 1 | 6000 | 0.97 | 0 | 1.5 | | |

TABLE 6

| | Electrostatic latent image between images | Developer | Fusing and fixation of toner component | Fog after long running | Heat resistance |
|---|---|---|---|---|---|
| Ex. 18 | none | two component | ○ | ○ | ○ |
| Ex. 19 | none | two component | ○ | Δ | ○ |
| Ex. 20 | none | two component | ○ | ○ | ○ |
| Ex. 21 | none | two component | ○ | ○ | ○ |
| Ex. 22 | none | two component | Δ | ○ | ○ |
| Ex. 23 | none | two component | Δ | ○ | ○ |
| Ex. 24 | none | two component | ○ | Δ | ○ |
| Ex. 25 | none | two component | ○ | ○ | Δ |
| Ex. 26 | none | two component | ○ | Δ | ○ |
| Ex. 27 | yes | two component | ○ | ○ | ○ |
| Comp. Ex. 7 | none | two component | X | X | ○ |
| Comp. Ex. 8 | none | two component | X | X | ○ |
| Comp. Ex. 9 | none | two component | X | Δ | ○ |
| Comp. Ex. 10 | none | two component | X | X | ○ |

What is claimed is:

1. A toner comprising:

toner particles containing a binder resin and a colorant; and organic fine particles admixed with the toner particles, the organic fine particles having a volume average particle size of 0.1 to 20 μm and containing alkyl carboxylic acid having a number average molecular weight of 300 to 1000.

2. The toner of claim 1, wherein the alkyl carboxylic acid has an acid value of 50 to 130 mg KOH/g.

3. The toner of claim 1, wherein the alkyl carboxylic acid has the number average molecular weight of 300 to 800.

4. The toner of claim 1, wherein the alkyl carboxylic acid has a specific gravity of 0.7 to 0.8 g/cc.

5. The toner of claim 1, wherein an amount of addition of the organic fine particles is in a range of 0.01 to 5 parts by weight with respect to 100 parts by weight of the toner particles.

6. The toner of claim 1, wherein inorganic fine particles are admixed with the toner particles, an amount of addition of the inorganic fine particles being in a range of 0.1 to 10 parts by weight with respect to 100 parts by weight of the toner particles.

7. The toner of claim 6, wherein the inorganic fine particles comprise silica and/or titanium oxide.

8. The toner of claim 6, wherein the inorganic fine particles include at least one kind selected from the group consisting of silica and titanium oxide, and strontium titanate.

9. The toner of claim 1, wherein the binder resin has a number average molecular weight of 3000 to 6000, a ratio of weight average molecular weight/number average molecular weight of 2 to 6, a glass transition point of 50 to 70° C., and a softening point of 90 to 110° C.

10. The toner of claim 1, wherein the binder resin has a number average molecular weight of 2000 to 10000, and a ratio of weight average molecular weight/number average molecular weight of 20 to 90.

11. A toner comprising:

toner particles containing a binder resin and a colorant; and organic fine particles admixed with the toner particles, the organic fine particles having a volume average particle size of 0.1 to 20 μm and containing alkyl carboxylic acid having an average number of carbon atoms of 20 to 70.

12. The toner of claim 11, wherein the alkyl carboxylic acid has an acid value of 50 to 130 mg KOH/g.

13. The toner of claim 11, wherein the alkyl carboxylic acid has the average number of carbon atoms of 22 to 55.

14. The toner of claim 11, wherein the alkyl carboxylic acid has a specific gravity of 0.7 to 0.8 g/cc.

15. The toner of claim 11, wherein an amount of the organic fine particles is in a range of 0.01 to 5 parts by weight with respect to 100 parts by weight of the toner particles.

16. The toner of claim 11, wherein inorganic fine particles are admixed with the toner particles, an amount of the inorganic fine particles being in a range of 0.1 to 10 parts by weight with respect to 100 parts by weight of the toner particles.

17. The toner of claim 16, wherein the inorganic fine particles comprise silica and/or titanium oxide.

18. The toner of claim 16, wherein the inorganic fine particles include at least one kind selected from the group consisting of silica and titanium oxide, and strontium titanate.

19. The toner of claim 11, wherein the binder resin has a number average molecular weight of 3000 to 6000, a ratio of weight average molecular weight/number average molecular weight of 2 to 6, a glass transition point of 50 to 70° C., and a softening point of 90 to 110° C.

20. The toner of claim 11, wherein the binder resin has a number average molecular weight of 2000 to 10000, and a ratio of weight average molecular weight/number average molecular weight of 20 to 90.

* * * * *